United States Patent [19]

Day

[11] Patent Number: 4,477,177

[45] Date of Patent: Oct. 16, 1984

[54] APPARATUS FOR PROJECTING A SCREEN PATTERN ONTO A PHOTOCONDUCTOR

[75] Inventor: Pierce B. Day, Pittsford, N.Y.

[73] Assignee: Eastman Kodak Company, Rochester, N.Y.

[21] Appl. No.: 466,401

[22] Filed: Feb. 15, 1983

[51] Int. Cl.[3] ..... G03G 15/00

[52] U.S. Cl. ..... 355/11; 355/71

[58] Field of Search ..... 355/11, 3 R, 4, 63, 355/71, 16, 66

[56] References Cited

U.S. PATENT DOCUMENTS

| | | | |
|---|---|---|---|
| 2,598,732 | 6/1952 | Walkup . | |
| 3,493,381 | 2/1970 | Maurer . | |
| 3,535,036 | 10/1970 | Starkweather . | |
| 3,914,047 | 10/1975 | Hunt, Jr. et al. . | |
| 3,958,877 | 5/1976 | Menon et al. . | |
| 3,961,847 | 6/1976 | Turner et al. . | |
| 3,961,848 | 6/1976 | Turner . | |
| 3,963,342 | 6/1976 | Stark et al. . | |
| 3,967,894 | 7/1976 | Tsilibes . | |
| 3,981,577 | 9/1976 | Tsilibes . | |
| 4,012,137 | 3/1977 | Goren | 355/11 X |
| 4,227,795 | 10/1980 | Bobbe et al. . | |

OTHER PUBLICATIONS

Research Disclosure No. 18542, Sep. 1979.
Research Disclosure No. 19629, Aug. 1980.

*Primary Examiner*—R. L. Moses
*Attorney, Agent, or Firm*—G. Herman Childress

[57] ABSTRACT

A duplicator has a movable photoconductor on which electrostatic images are formed. A rotatable transparent cylinder positioned adjacent the front side of the photoconductor has a screen pattern thereon. Wheels on the cylinder contact the photoconductor so that the cylinder is rotated in response to movement of the photoconductor. An elongate light shield positioned inside the cylinder has a first slot adjacent the portion of the cylinder near the photoconductor, and a Fresnel lens is positioned in the slot. Light rays from a point source located outside the cylinder pass through a second slot in the shield and are reflected from a mirror inside the cylinder onto the Fresnel lens. The lens collimates the light rays and directs them through the screen on the transparent drum to thereby project onto the photoconductor an image of the screen pattern on the cylinder.

7 Claims, 3 Drawing Figures

APPARATUS FOR PROJECTING A SCREEN PATTERN ONTO A PHOTOCONDUCTOR

BACKGROUND OF THE INVENTION

The present invention relates to apparatus for projecting a screen pattern onto a moving photoconductor of a duplicator or the like and, more particularly, to apparatus for projecting a dot screen pattern using a point light source.

The use of screen patterns and screening processes to improve the rendition of images is well known in the fields of photography and electrography. See, for example, U.S. Pat. No. 3,493,381, which issued in the name of R. E. Maurer on Feb. 3, 1970, and U.S. Pat. No. 2,598,732, which issued in the name of L. E. Walkup on June 3, 1952. These patents also disclose a variety of screen patterns including circular or rectangular dots, checkerboard patterns, lines, etc.

U.S. Pat. No. 4,227,795, which issued in the name of R. M. Bobbe et al on Oct. 14, 1980, is another example of the use of a screening process in multicolor electrography. As indicated in the latter patent, the screening process may be carried out by transmitting a light image of the original document through a screen to expose a charged photoconductive member or, alternatively, an image of a screen pattern can be formed on the charged photoconductor either before or after the formation of the image of the original document to be copied by flashing a lamp adjacent the screen. Such patent also discloses dot screen patterns. Because the dot screen is stationary and the photoconductor is moving, a timing mechanism is provided to flash the lamp for the screen at the proper time in a cycle of operation.

U.S. Pat. No. 3,535,036 discloses the use of either a point light source or an elongate lamp in half-tone screening apparatus. Such apparatus requires one or more lens elements between the light source and the photoconductor.

It is also known to transmit a screen pattern through a transparent charged photoconductor. In this regard, reference is made to Item 18542 on page 500 of the September, 1979 edition of Research Disclosure, published by Industrial Opportunities, Ltd., Homewell, Avant Hampshire, PO9-1EF, United Kingdom. Such publication discloses the formation of a half-tone illumination pattern on a transparent photoconductive belt by using a roller positioned in contact with the inside surface of the belt. The roller comprises an opaque cylindrical shell which engages the belt and is driven synchronously with the belt. A suitable pattern, such as a pattern of apertures, is formed on the roller. Located inside the roller is a semi-cylindrical light shield and an elongate cylindrical light source. Rays of light from the source pass through a slot in the light shield onto the roller to thereby project the pattern of apertures onto the belt. Because the belt is transparent, the light pattern selectively discharges the charged, opposite surface of the photoconductive belt. Research Disclosure Item No. 19629 on page 321 of the August, 1980 edition of Research Disclosure discloses a modification of the first mentioned RD publication wherein a multi-colored dot screen is provided for a color copier.

When screen patterns are used the screen is sometimes located closely adjacent to the photoconductor and therefore may become contaminated, for example by particles of toner from the photoconductor. Accordingly, apparatus can be provided for cleaning such particles from the screen. In this regard, reference is made to U.S. Pat. Nos. 3,961,848 and 3,958,877.

SUMMARY OF THE INVENTION

In accordance with the present invention apparatus is provided for projecting a screen pattern onto a moving photoconductor. The apparatus of the invention includes a transparent cylinder having a screen pattern thereon with a portion of the cylinder being located adjacent the photoconductor. The cylinder is driven in synchronism with the photoconductor. An elongate light shield positioned inside the cylinder has a first slot near the portion of the cylinder located adjacent the photoconductor and a second slot spaced from the first slot. A Fresnel lens is positioned across the first slot in the light shield, and a light source is located outside the cylinder. Means are provided for directing light from the source through the second slot, the Fresnel lens and the screen pattern to project an image of the screen pattern onto the photoconductor.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
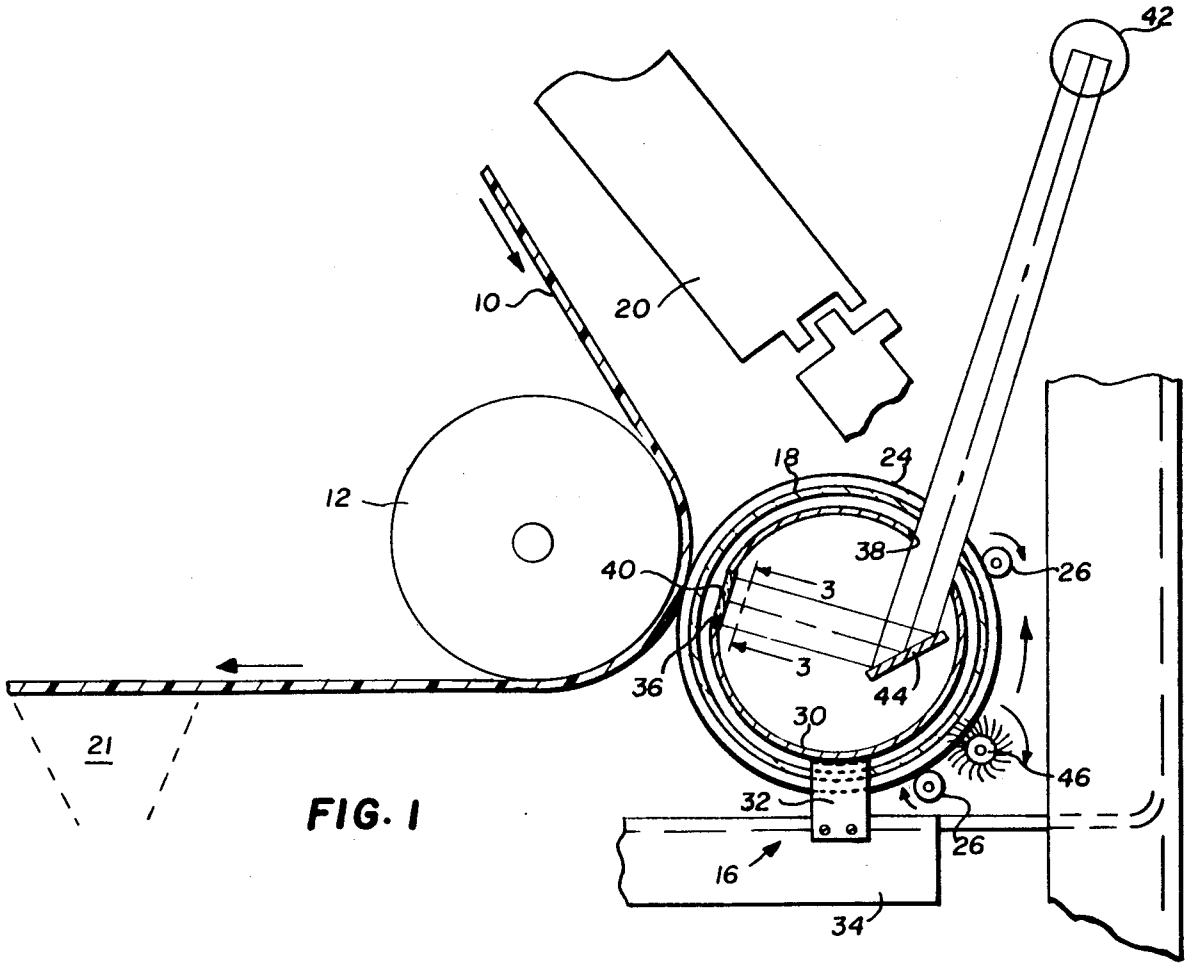
FIG. 1 is a transverse section through a portion of a copier/duplicator showing apparatus of the invention for projecting a screen pattern onto a moving photoconductor.
Figure 2:
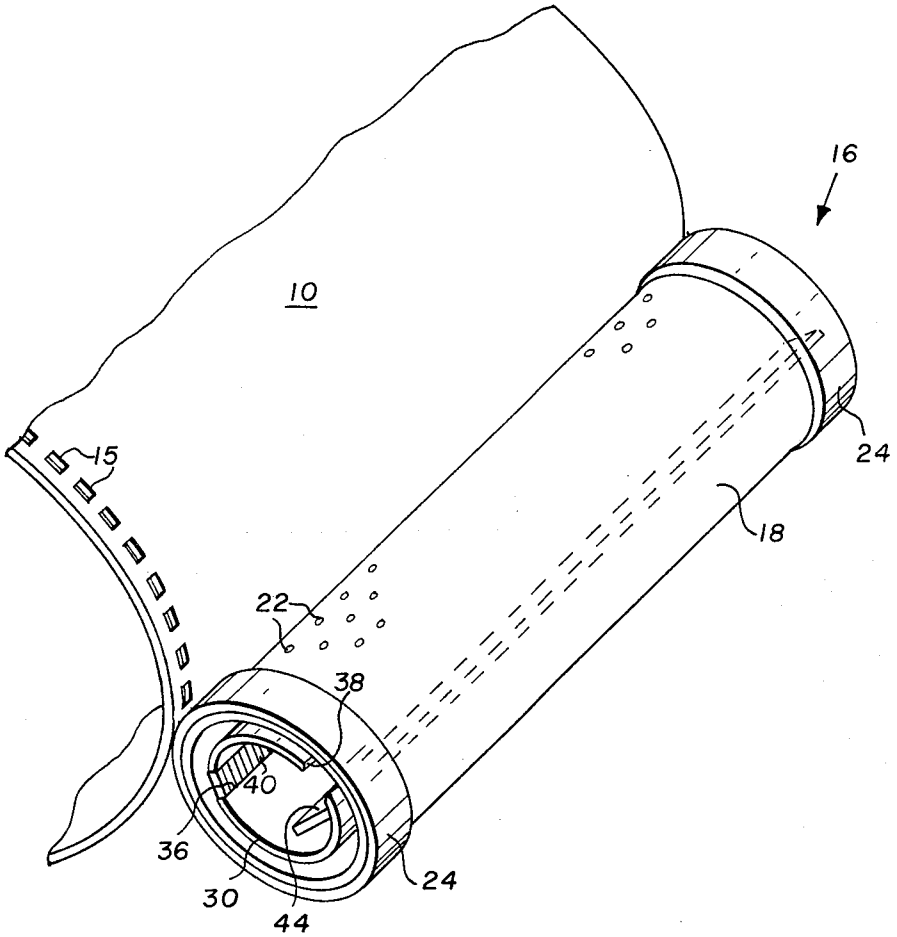
FIG. 2 is a perspective view of portions of the apparatus illustrated in FIG. 1.

Referring now to FIGS. 1 and 2 of the drawings, a photoconductor 10 in the form of a flexible, endless belt travels around a plurality of rollers, one of which is shown at 12. One of the rollers is a drive roller used for advancing the photoconductor in the direction indicated by the arrows in FIG. 1. The photoconductor has a plurality of sprocket holes or slots 15. The belt travels along an endless path leading past a plurality of work stations of a copier/duplicator or the like. Such a photoconductor and drive system are known in the art and are illustrated, for example, in commonly assigned U.S. Pat. No. 3,914,047 which issued on Oct. 21, 1975 in the name of W. E. Hunt Jr. et al and is entitled SYNCHRONIZING CONTROL APPARATUS FOR ELECTROPHOTOGRAPHIC APPARATUS UTILIZING DIGITAL COMPUTER.

In accordance with the present invention apparatus generally designated 16 is provided for projecting a dot screen pattern onto a moving photoconductor, such as the photoconductor 10. While the invention is described in connection with a flexible photoconductor 10, it will be understood that the invention is equally applicable for use with other photoconductor configurations, such as rigid drums.

Apparatus 16 comprises an elongate transparent cylinder 18 that can be fabricated from glass, Lucite, or other suitable materials. Cylinder 18 is positioned closely adjacent to the photoconductor 10 in the area where the photoconductor travels around drive roller 12. Preferably the cylinder 18 is located adjacent to the primary charger 20 of the duplicator which is effective to provide a static electric charge on the adjacent surface of the photoconductor just before the photoconductor reaches the cylinder and drive roller. Thus the dot pattern is projected onto the photoconductor after it passes the charger 20 and before it reaches an exposure station 21. However, apparatus 16 can be located to project the dot pattern onto the photoconductor after it passes the exposure station.

As best illustrated in FIG. 2, the exterior surface of the cylinder 18 is covered with a pattern of opaque dots 22. The dots are shown arranged in rows and columns around the surface of the cylinder 18 but could also be arranged in other patterns or arrangements of dots.

Means are provided for coupling the cylinder 18 to the photoconductor 10 so that the cylinder is rotated in response to movement of the photoconductor and at a surface speed that is coordinated with movement of the photoconductor. As illustrated in FIGS. 1 and 2, the cylinder 18 is driven by the photoconductor by providing a pair of drive members in the form of thin tires 24 or other friction members that are secured to end portions of cylinder 18 and bear against the side edge portions of photoconductor 10. Thus when drive roller 12 moves photoconductor 10 is driven in the direction indicated by the arrow, the friction members 24 rotate cylinder 18 in a counter-clockwise direction as viewed in FIG. 1 with the surface speed of the cylinder being substantially synchronized with the surface speed of the photoconductor. Members 24 can be held in driving engagement with the photoconductor by a plurality of idler rollers 26 (FIG. 1) positioned around the surface of the members 24 in spaced relation to the drive roller 12.

An elongate, generally cylindrical light shield 30 is positioned inside cylinder 18 and is substantially coaxial therewith. The light shield 30 is spaced slightly from the inner wall of cylinder 18 and is held in a fixed position within the cylinder by, for example, one or more brackets 32 secured to a frame member 34 of the copier/duplicator. The light shield 30 has a first, axially-extending, elongate slot 36 through the portion of the shield nearest the photoconductor 10. A second and similar axially-extending elongate slot 38 in light shield 30 is circumferentially spaced from the first slot. The portions of the light shield separated by slots 36, 38 can be held together by cylindrical portions of the light shield at the ends of the shield or, alternatively, the light shield can be made in two semi-cylindrical sections with the upper section also being connected to a frame member by means of a bracket, such as the bracket 32.

Figure 3:
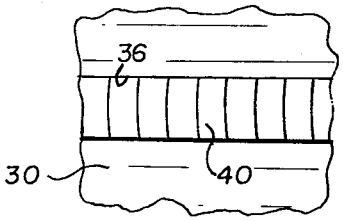
FIG. 3 is a detailed fragmentary view taken along line 3—3 in FIG. 1.

An elongate, rectangular Fresnel lens 40 is positioned within and extends across the first slot 36 in the light shield. The Fresnel lens can be a relatively narrow section (approximately 2.5 cm. wide) taken out of the center of a Fresnel lens of about 35 cm. in diameter. A segment of the lens is illustrated in FIG. 3. The lens extends in a direction transverse to the direction of movement of the photoconductor 10 and the cylinder 18. As known in the art, the Fresnel lens is effective to collimate light rays passing through the lens.

A light source 42 is located outside the cylinder 18 and light shield 30. Preferably the light source is a point light source, such as a tungsten halogen projection lamp. The light source is located so that light rays from the source can pass through slot 38. A light shield or reflector (not shown) can be provided adjacent source 42 for directing rays from source 42 through slot 38.

A mirror 44 is positioned within the light shield 30 and located relative to slot 38 and Fresnel lens 40 so that light rays emanating from the lamp 42 pass through slot 38, are reflected from the surface of mirror 44 and directed through the Fresnel lens 40, thereby to produce a collimated beam of light. The light beam passes through the cylinder 18 to project a dot pattern of light onto the adjacent surface of the photoconductor 10. This pattern of light selectively discharges the electrostatic charge placed on the photoconductor by the charger 20 so that the resulting discharged pattern on the photoconductor corresponds to the pattern of dots 22 on the cylinder 18.

Mirror 44 can be secured in position within the light shield by any suitable means, such as a bracket (not shown) that attaches the mirror to the shield 30 or to a frame member of the copier/duplicator. Mirror 44 provides flexibility for the apparatus of the invention by allowing the light source 42 to be located at a position not normally occupied by other portions of the copier/duplicator. Lamp 42 is located relative to lens 40 so that the distance traveled by light rays from the lamp to the lens is substantially equal to the focal length of the lens. Thus the dot pattern is sharply focused on the photoconductor.

Photoconductor 10 passes a cleaning station just prior to the time it reaches the primary charger 20. However, some residual toner particles or other contamination may be present on the photoconductor as it passes the cylinder 18. Such contaminants can be transferred to the cylinder 18. Over a period of time such contamination can accummulate on the cylinder and adversely affect the projection of the dot pattern onto the photoconductor. Accordingly, a cleaning brush 46 (FIG. 1) is provided and located in a position where it contacts the outer surface of the cylinder 18 between the tires 24. The brush is spaced from the portion of the cylinder between the lens and the photoconductor. Brush 46 may comprise a brush or pad capable of removing contaminants from cylinder 30. The brush is periodically serviced to remove any accumulation of contaminants from the brush. The brush can be stationary, or it can be driven in either a clockwise or counterclockwise direction as viewed in FIG. 1.

The projecting apparatus of the present invention can be operated continuously for all modes of copying or, alternatively, it can be activated by an operator only when particular originals are to be copied. In operation, light rays from lamp 42 pass through slot 38, are reflected from mirror 44 and pass through the Fresnel lens 40 to provide a collimated beam of light. The resulting light beam passes through the dot pattern in the cylinder 18 and the photoconductor is selectively discharged in a pattern corresponding to the pattern of dots on the cylinder. The selective discharge of the electrostatic charge on the photoconductor 10 can substantially enhance an image, as is well known in the art.

The use of a Fresnel lens and a point light source located at the local length of the lens produces a sharply focused image on the photoconductor 10 of the pattern of dots 22 on that portion of the cylinder 18 between the Fresnel lens 40 and the photoconductor. The light rays also pass through the portion of the dot pattern on the cylinder 18 adjacent slot 38 as the rays travel from the light source to mirror 44. However, an image of that portion of the dot pattern will be unfocused (and thus unsharp) when it reaches the photoconductor 10. This unsharp unfocused image has little or no effect on the charge on the photoconductor. Therefore it does not significantly affect the result produced by the principal, sharply focused dot pattern produced by the dots 22 between the Fresnel lens and the photoconductor.

By way of example, cylinder 18 can be about 5.0 cm. in diameter and the exterior surface of the cylinder can be about 0.25 cm. from the photoconductor. Lamp 42 can be a 25 watt tungsten halogen lamp located about 20 cm. from the photoconductor.

Many arrangements of dot patterns, and shapes and sizes of dots or the like are known in the art. Such are disclosed, in part, in the disclosures discussed in the Background of the Invention in this specification. It will be apparent to those skilled in the art that dots 22 can be any of the various types of patterns, shapes etc. known to the art.

The invention has been described in detail with particular reference to a preferred embodiment thereof, but it will be understood that variations and modifications can be effected within the spirit and scope of the invention.

I claim:

1. Apparatus for projecting a screen pattern onto a moving photoconductor, the apparatus comprising:

a transparent cylinder having a screen pattern thereon, a portion of the cylinder being located adjacent the photoconductor;

means for driving the cylinder in synchronism with the photoconductor;

an elongate light shield positioned inside the cylinder, the light shield having a first slot therein near the portion of the cylinder located adjacent the photoconductor and a second slot therein spaced from the first slot;

a Fresnel lens positioned across the first slot in the light shield;

a light source located outside the cylinder; and means for directing light from the source through the second slot, the lens and the screen pattern to project an image of the screen pattern onto the photoconductor.

2. The invention as set forth in claim 1 wherein the light source is a point light source, and the directing means comprises a mirror positioned inside the light shield so that light entering the shield through the second slot is reflected onto the lens.

3. The invention as set forth in claim 1 wherein the driving means comprises means coupling the cylinder directly to the photoconductor so that the cylinder is rotated in response to movement of the photoconductor, and the invention further comprising means for cleaning the exterior surface of the cylinder.

4. The invention as set forth in claim 1 wherein the screen pattern comprises a dot pattern, and wherein the light path from the source to the lens is substantially equal to the focal length of the lens.

5. Apparatus for projecting a screen pattern onto a moving photoconductor, the apparatus comprising:

a transparent cylinder having a screen pattern thereon, a portion of the cylinder being located adjacent the photoconductor;

means for rotating the cylinder in synchronism with movement of the photoconductor;

an elongate light shield positioned inside the cylinder, the light shield having a first elongate slot therein near the portion of the cylinder located adjacent the photoconductor and a second elongate slot therein spaced from the first slot;

an elongate Fresnel lens positioned across the first slot in the light shield, the lens extending transverse to the direction of movement of the photoconductor;

a point light source located outside the cylinder and positioned for directing light rays from the source through the second slot; and a mirror mounted inside the light shield and positioned so that light rays entering the shield through the second slot are reflected onto the lens to produce a collimated beam of light that passes through the screen pattern and projects an image of the screen pattern onto the photoconductor.

6. The invention as set forth in claim 5 wherein the means for rotating the cylinder in synchronism with movement of the photoconductor comprises wheels on end portions of the cylinder, the wheels engaging the photoconductor so that movement of the photoconductor is imparted to the cylinder.

7. The invention as set forth in claim 6 wherein the light path from the source to the lens is substantially equal to the focal length of the lens, and further comprising means for cleaning the cylinder, the cleaning means being spaced from the portion of the cylinder between the lens and the photoconductor.

* * * * *